US010010119B2

(12) United States Patent
Butler et al.

(10) Patent No.: US 10,010,119 B2
(45) Date of Patent: Jul. 3, 2018

(54) NURSING COVER

(71) Applicant: SKIP HOP, INC., New York, NY (US)

(72) Inventors: Rahnee Butler, Hawthorne, NY (US); Chelsea Carter, Jersey City, NJ (US); Ellen Diamant, New York, NY (US)

(73) Assignee: SKIP HOP, INC., New York, NY (US)

( * ) Notice: Subject to any disclaimer, the term of this patent is extended or adjusted under 35 U.S.C. 154(b) by 113 days.

(21) Appl. No.: 15/204,406

(22) Filed: Jul. 7, 2016

(65) Prior Publication Data

US 2018/0007980 A1 Jan. 11, 2018

(51) Int. Cl.

| | |
|---|---|
| ***A41D 1/215*** | (2018.01) |
| ***A41D 1/20*** | (2006.01) |
| ***A41D 31/00*** | (2006.01) |
| ***A41D 27/28*** | (2006.01) |

(52) U.S. Cl.

CPC ..... *A41D 1/215* (2018.01); *A41D 1/205* (2013.01); *A41D 27/28* (2013.01); *A41D 31/00* (2013.01); *A41D 2300/33* (2013.01); *A41D 2400/22* (2013.01); *A41D 2500/20* (2013.01)

(58) Field of Classification Search

CPC ..... A41D 1/205; A41D 1/215; A42B 1/206
USPC ..... 2/104, 88, 51, 69
See application file for complete search history.

(56) References Cited

U.S. PATENT DOCUMENTS 4,384,371 A * 5/1983 Sonne ..... A42B 1/206 2/104
4,631,754 A 12/1986 Ryan
4,651,349 A 3/1987 Heiler
4,797,953 A 1/1989 Dameron
4,989,268 A * 2/1991 Stolhand ..... A41D 1/205 2/104
4,995,116 A 2/1991 Beauchamp et al.
(Continued)

FOREIGN PATENT DOCUMENTS

CN 201194549 2/2009
CN 201536647 8/2010
(Continued)

OTHER PUBLICATIONS http://www.amazon.com/Basic-Comfort-Nursing-Bib-Ecru/dp/B00003XAKL (commercial embodiment of U.S. Pat. No. 5,544,364).

(Continued)

*Primary Examiner* — Gloria Hale
(74) *Attorney, Agent, or Firm* — Stephen J. Weyer, Esq.; James Hayne, Esq.; Stites & Harbison, PLLC

(57) ABSTRACT

A nursing cover for covering a mother's body and a nursing infant. The nursing cover includes a substantially cylindrical main body having an upper edge defining a top opening and lower edge defining a bottom opening and a means for adjusting the size of the top opening. The nursing cover further includes a viewing window having an upper edge positioned adjacent to the upper edge of the main body and a lower edge positioned along the main body towards the lower edge of the main body and boning positioned adjacent to the lower edge of the viewing window with the boning configured to maintain the lower edge of the viewing window away from the mother's chest such that the viewing window is disposed to cross the mother's line of sight from her eyes to the nursing infant.

17 Claims, 5 Drawing Sheets

(56) References Cited

U.S. PATENT DOCUMENTS

| | | | | |
|---|---|---|---|---|
| 5,034,999 | A * | 7/1991 | Lubbers | A41D 1/205 2/104 |
| 5,038,411 | A | 8/1991 | St. Armand | |
| 5,090,059 | A | 2/1992 | Kahl | |
| 5,259,068 | A * | 11/1993 | Carroll | A41D 1/205 2/104 |
| 5,452,960 | A * | 9/1995 | Kuhlenschmidt | B41J 5/10 341/22 |
| 5,479,662 | A * | 1/1996 | Runco | A41D 1/205 2/104 |
| 5,544,364 | A * | 8/1996 | Weber | A41D 1/205 2/104 |
| 5,652,958 | A * | 8/1997 | Farrell-Mestas | A41D 1/205 2/104 |
| 5,652,960 | A | 8/1997 | Kaknevicius | |
| D393,737 | S | 4/1998 | Tymous | |
| 5,848,439 | A | 12/1998 | Huseth et al. | |
| D403,488 | S | 1/1999 | Mitchell | |
| D405,940 | S | 2/1999 | Payne | |
| 6,012,756 | A | 1/2000 | Clark-Dickson | |
| 6,216,274 | B1 | 4/2001 | Harris | |
| 6,301,713 | B1 | 10/2001 | Aceves et al. | |
| 7,114,191 | B1 * | 10/2006 | Butler-Penenberg | A41D 1/205 2/104 |
| 7,207,070 | B1 * | 4/2007 | Swarez-Ballesteros | A41D 1/205 2/104 |
| D542,509 | S | 5/2007 | Campbell et al. | |
| 7,765,613 | B2 | 8/2010 | Carr | |
| D657,179 | S | 4/2012 | Cupples et al. | |
| 8,151,372 | B2 | 4/2012 | Densmore et al. | |
| 8,904,579 | B2 | 12/2014 | Davis | |
| 8,990,968 | B2 | 3/2015 | Garegnani | |
| 9,003,565 | B1 | 4/2015 | Leach | |
| 2009/0193561 | A1 | 8/2009 | Masukawa et al. | |
| 2010/0281598 | A1 | 11/2010 | Densmore et al. | |
| 2011/0191934 | A1 | 8/2011 | Seyed et al. | |
| 2012/0131723 | A1 | 5/2012 | Greenwood | |
| 2012/0151657 | A1 * | 6/2012 | Gibbons | A41D 1/205 2/104 |
| 2012/0240306 | A1 * | 9/2012 | Garegnani | A41D 1/205 2/104 |
| 2014/0007315 | A1 | 1/2014 | Toro-Gerstein | |

FOREIGN PATENT DOCUMENTS

| | | |
|---|---|---|
| GB | 2399485 | 9/2004 |
| JP | H-09157915 | 6/1997 |
| JP | 2000008207 | 1/2000 |
| KR | 100848877 | 7/2008 |
| WO | WO-2002/067706 | 9/2002 |

OTHER PUBLICATIONS http://www.daintybaby.com/Jolly_Jumper_Nursing_Poncho_p/jjnurpo8.htm (attached as .pdf file).
http://www.aliexpress.com/item/Cotton-Nursing-Privacy-Nursing-Cover-Canopy-nursing-Shawl-breast-feeding-Wrap-Covers-Baby-nursing-gowns-free/1007374888.html (attached as a .pdf file).
http://littlebowgirl.com/2014/04/23/sophie-day-out-x-tea-for-two/.
https://www.varagesale.com/trinity-s-selling-group-fl/i/6jd3tcxj-nursing-cover-with-see-through-mesh-top.
https://cotradeco.com/products/684-peekaboo-multi-purpose-baby-blanket (attached as a .pdf file).

* cited by examiner

NURSING COVER

FIELD OF THE INVENTION

The present invention relates to a cover for placement over a mother and a nursing infant and in particular a nursing cover with a viewing window disposed to cross the mother's line of sight from her eyes to the nursing infant.

BACKGROUND OF THE INVENTION

Nursing covers are used to at least partially cover a mother and a nursing infant in order to provide privacy to the mother and their infant while the mother is breast feeding the infant. A typical nursing cover is in the form of a blanket or shawl which his draped over the mother's shoulders. These typical nursing cover are made of an opaque material which completely hides the nursing infant from view.

SUMMARY OF THE INVENTION

The present invention is directed to a nursing cover which advantageously allows the mother to see the nursing infant while still maintaining the privacy of the mother.

In one exemplary embodiment of the present invention, a nursing cover includes a substantially cylindrical main body having an upper edge defining a top opening through which the mother's head extends and a lower edge defining a bottom opening through which the mother's body extends. The nursing cover further includes a means for adjusting the size of the top opening and a viewing window adjacent to the top opening which has a transparent panel that allows the mother to see the nursing infant while nursing. Specifically, the viewing window has an upper edge adjacent to the upper edge of the main body and a lower edge positioned along the main body towards the lower edge of the main body with boning positioned adjacent to the lower edge of the viewing window that is configured to maintain the lower edge of the viewing window away from the mother's chest such that the viewing window (and transparent panel) is disposed to cross the mother's line of sight from her eyes to the nursing infant. Each end of the boning contacts the mother's chest with the boning curving away from the mother's chest, and in at least some embodiments the boning is tacked to the main body to prevent rotation of the boning within the boning channel and thus ensuring that the boning remains curved away from the mother's chest.

The means for adjusting the size of the top opening is a draw string comprising a drawcord channel defined around the upper edge of the main body and a drawcord extending through the drawcord channel with two ends of the drawcord extending out of the drawcord channel through openings defined at one side of the main body. Furthermore, the exemplary draw string comprises a toggle configured to selectively hold each of the two ends of the drawcord such that the length of the two ends extending out of the drawcord channel can be adjusted in order adjust the size of the top opening in a manner typical of draw strings.

In operation, when top opening of the main body is in an open position a mother is able to readily place the nursing cover in a desired position on the mother's body. When the top opening of the main body is in a closed position, the top opening is smaller than the mother's shoulders such that the nursing cover rests securely on the mother's shoulders. It is contemplated that a mother can readily adjust the draw string between the opened position and the closed position by reaching out through the bottom opening of the nursing cover and pulling the two ends of the drawcord outward to increase their length and thus decrease the size of the top opening. The toggle is then used to prevent the two ends of the drawcord from sliding back into the drawcord channel, but it contemplated that other means of securing the two ends of the drawcord can be used, including simply tying the two ends into a bow knot or the like.

With respect to the viewing window, in the exemplary nursing cover, the upper edge of the viewing window is coextensive with a portion of the drawcord channel. In this way, upon pulling the two ends of the drawcord outward and decreasing the size of the top opening, the length of the upper edge of the viewing window is also reduced. The boning positioned adjacent to the lower edge of the viewing window prevents the lower edge of the viewing window from similarly shortening. Instead, as a result of the reduced length of the upper edge of the viewing window, the boning is bent further which pushes the lower edge of the viewing window farther away from the mother's chest, advantageously improving the mother's view of the nursing infant.

BRIEF DESCRIPTION OF THE DRAWINGS

The present invention will now be described with regard to the figures as identified below.

DETAILED DESCRIPTION

Figure 1:
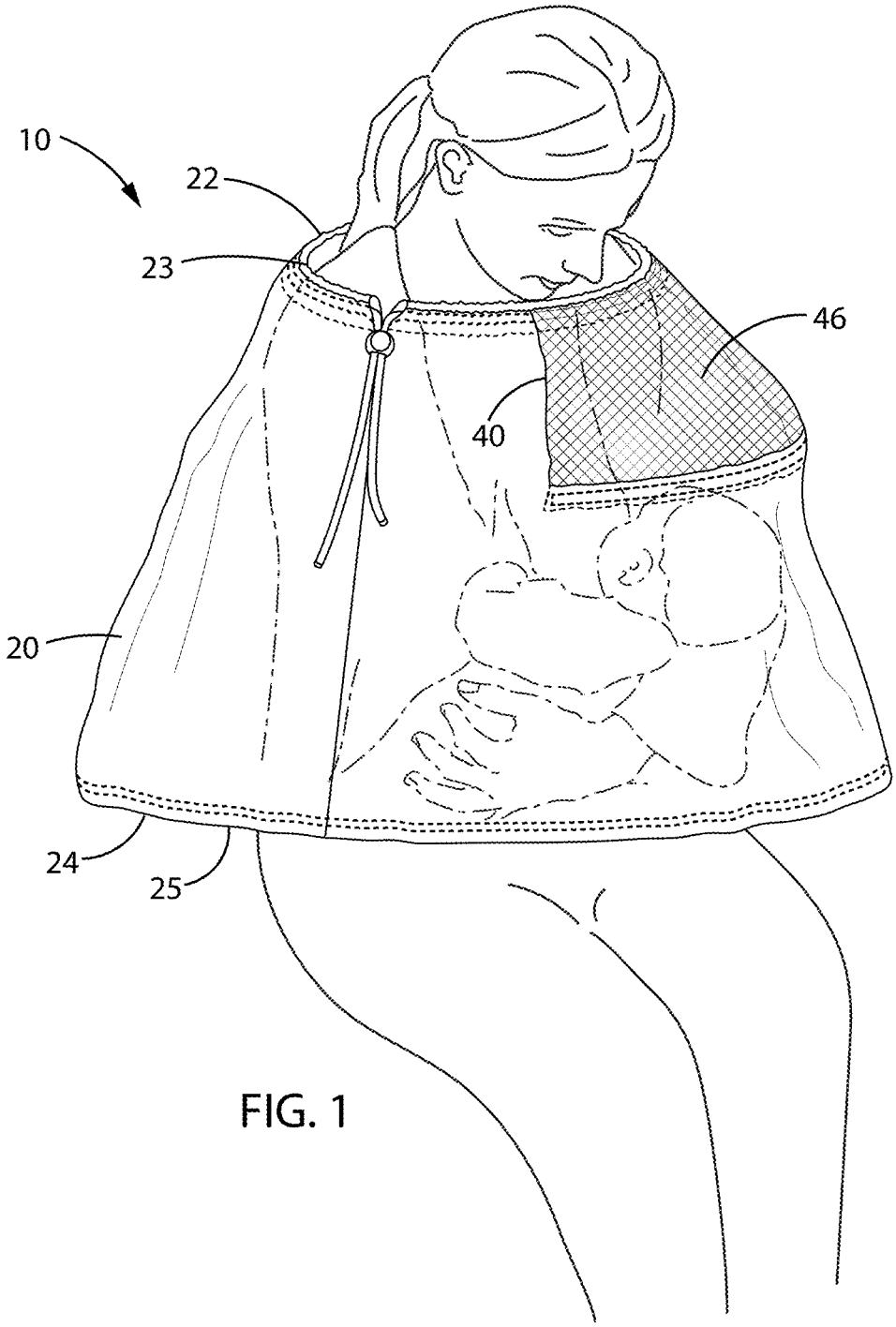
FIG. 1 shows a nursing cover made in accordance with the present invention covering a mother's body and a nursing infant.

The present invention will now be described with regard to the Figures. Referring first specifically to FIG. 1, a nursing cover 10 made in accordance with one exemplary embodiment of the present invention is shown covering a mother's body and a nursing infant. The nursing cover 10 includes a substantially cylindrical main body 20 having an upper edge 22 defining a top opening 23 through which the mother's head extends and a lower edge 24 defining a bottom opening 25 through which the mother's body extends. The nursing cover 10 further includes a means for adjusting the size of the top opening 23 (see e.g. FIGS. 6-9 and the discussion to follow) and a viewing window 40 adjacent to the top opening 23 which, in this embodiment has a transparent panel 46 extending across the viewing window 40 allowing the mother to see the nursing infant while nursing.

Figure 4:
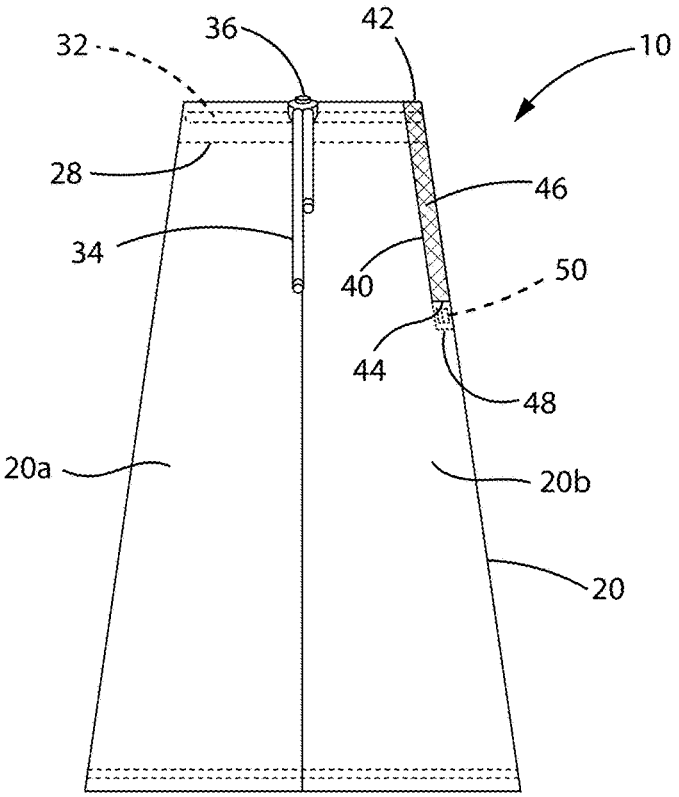
FIG. 4 is a right side view of the nursing cover of FIG. 2.
Figure 5:
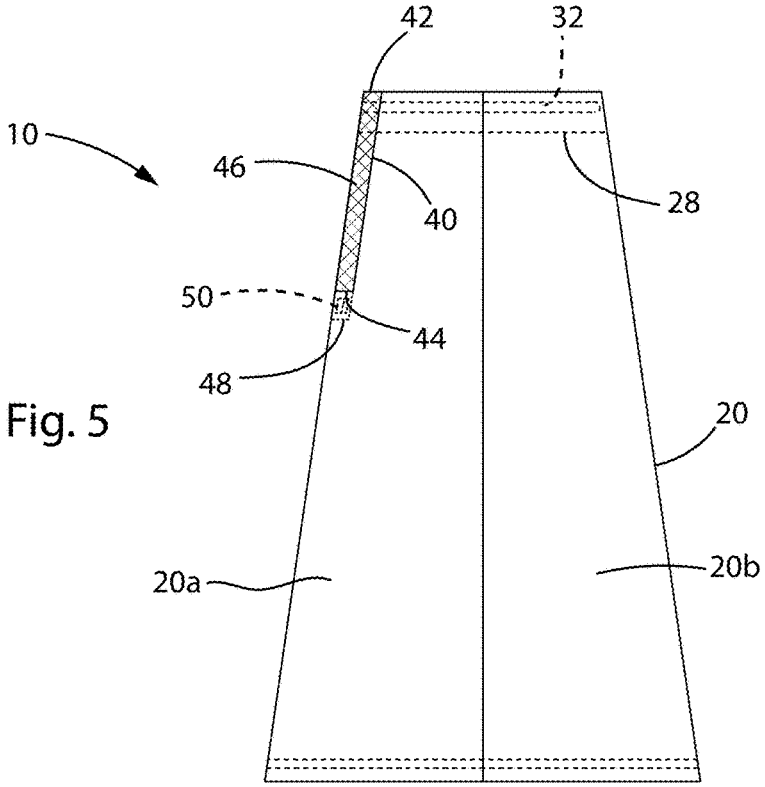
FIG. 5 is a left side view of the nursing cover of FIG. 2.

Referring now to FIGS. 2-7, in the exemplary nursing cover 10, the main body 20 is comprised of a front panel 20*a* and a back panel 20*b* which, as shown in FIGS. 4 and 5, are sewn together on either side of the nursing cover 10 from the upper edge 22 to the lower edge 24 to form the main body 20. It is contemplated, however, that in other embodiments, the main body 20 can be comprised of any number of panels, including one continuous panel. In this exemplary embodiment, the main body 20 is made of a woven fabric, such as, for example, a soft, breathable stretch fabric which provides increased ventilation and air flow to maintain the comfort of both the mother and infant. To this end, the transparent panel 46 is made of a mesh fabric which further increases ventilation and air flow while also allowing the mother to see the nursing infant, as illustrated in FIG. 1.

Figure 2:
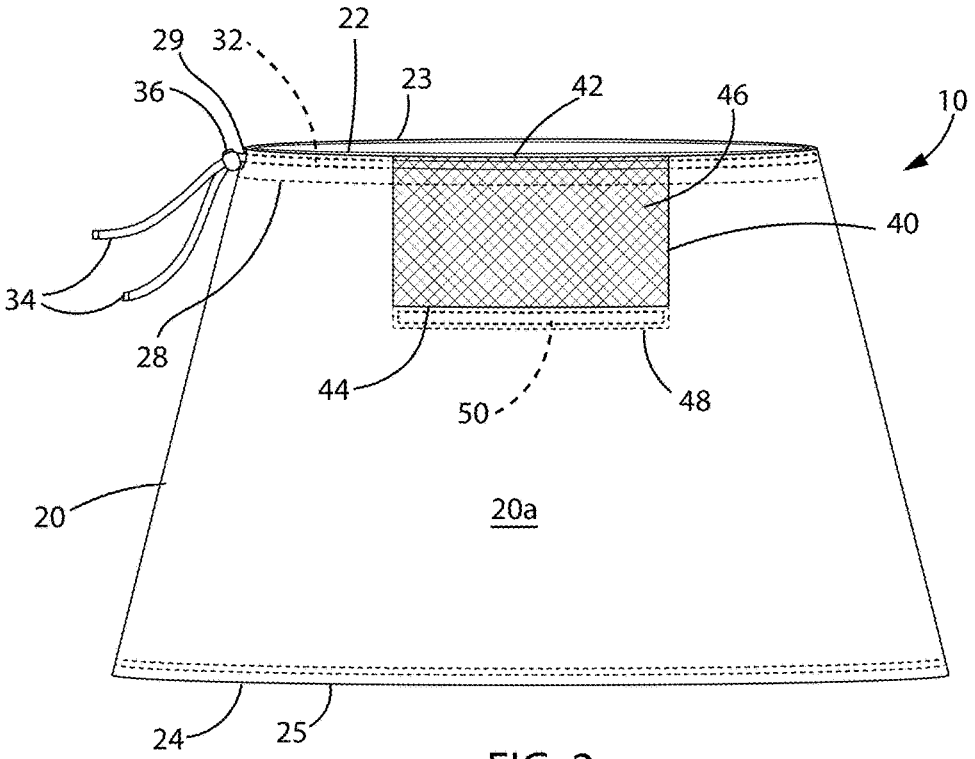
FIG. 2 is a front view of the nursing cover of FIG. 1 shown in isolation with the top opening in an open position.
Figure 3:
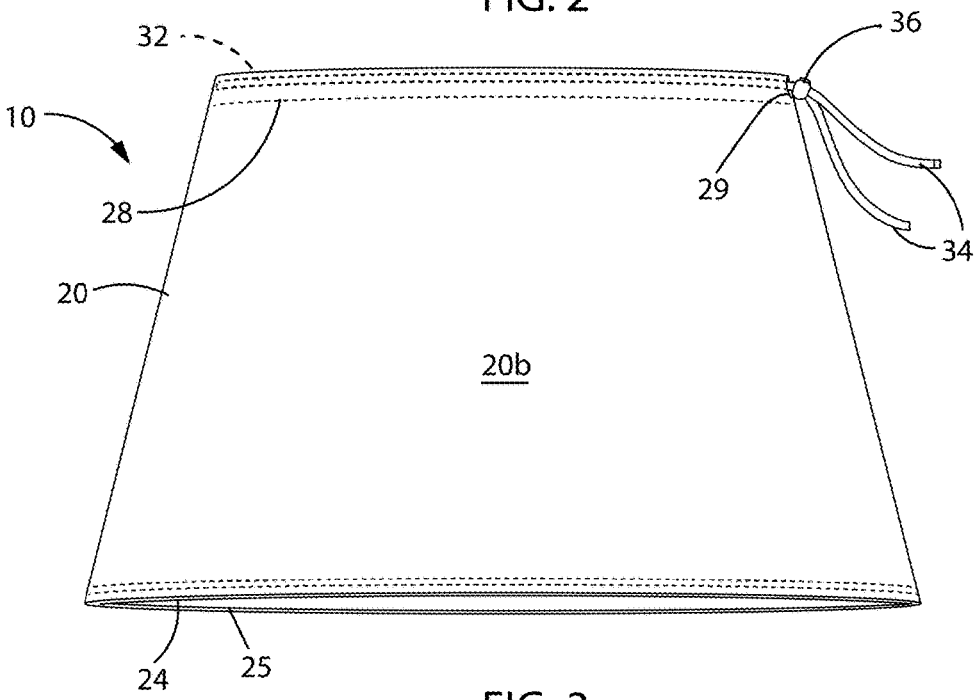
FIG. 3 is a rear view of the nursing cover of FIG. 2.

Referring now specifically to FIG. 2, the viewing window 40 has an upper edge 42 adjacent to the upper edge 22 of the main body 20 and a lower edge 44 positioned along the main body 20 towards the lower edge 24 of the main body 20. In this exemplary embodiment, the upper edge 42 and the lower edge 44 of the viewing window 40 are substantially parallel and have a substantially similar length such that the viewing window 40 is a rectangle, but other shapes and sizes of the viewing window 40 are also contemplated.

As also shown in FIG. 2, a boning channel 48 is defined along the lower edge 44 of the viewing window 40 with boning 50 positioned within the boning channel 48 such that the boning 50 is positioned adjacent to the lower edge 44 of the viewing window 40. The boning 50 is configured to maintain the lower edge 44 of the viewing window 40 away from the mother's chest such that the viewing window 40 (and transparent panel 46) is disposed to cross the mother's line of sight from her eyes to the nursing infant. Specifically, in the exemplary nursing cover 10, the boning 50 is comprised of a flexibly rigid curved member which can be made of a variety of suitable materials known in the art. Each end of the boning 50 contacts the mother's chest with the boning 50 curving away from the mother's chest. The boning channel 48 is closed at both ends, completely enclosing the boning 50, and in at least some embodiments, the boning 50 is tacked to the main body 20 to prevent rotation of the boning 50 within the boning channel 48 and thus ensuring that the boning 50 remains curved away from the mother's chest.

Referring once again to FIGS. 2-7, in the exemplary nursing cover 10, the means for adjusting the size of the top opening 23 is a draw string. Specifically, the draw string of the present invention comprises a drawcord channel 28 defined around the upper edge 22 of the main body 20 and a drawcord 32 extending through the drawcord channel 28 with two ends 34 of the drawcord 32 extending out of the drawcord channel 28 through openings 29 defined at one side of the main body 20. Furthermore, the exemplary draw string comprises a toggle 36 configured to selectively hold each of the two ends 34 of the drawcord 32 such that the length of the two ends 34 extending out of the drawcord channel 28 can be adjusted in order adjust the size of the top opening 23 in a manner typical of draw strings. Although not expressly shown, in the exemplary nursing cover 10 of the present invention, the drawcord 32 is tacked to the main body 20 at at least one location, so that the drawcord 32 is permanently fixed to the main body 20. For example, the drawcord 32 can be tacked to the main body 20 at the seam connecting the front panel 20*a* to the back panel 20*b* on the side of the main body 20 opposite the openings 29 of the drawcord channel 28.

Figure 6:
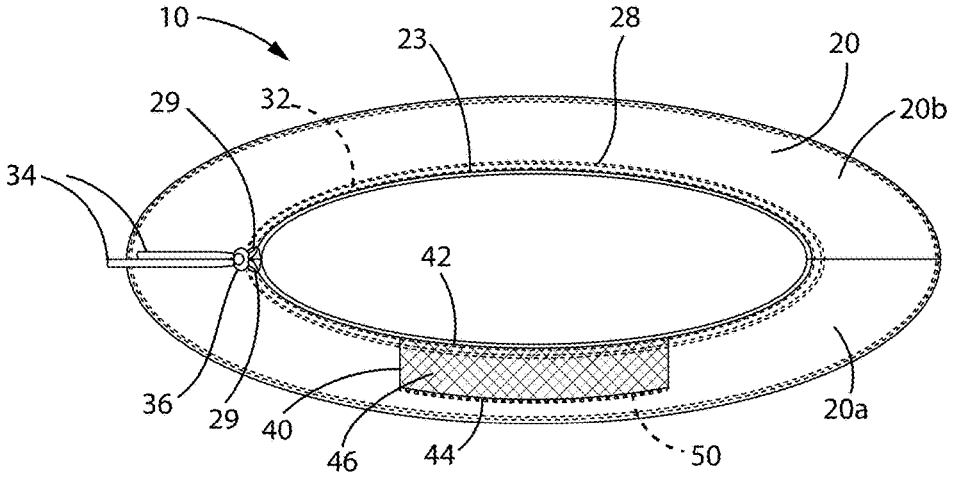
FIG. 6 is a top view of the nursing cover of FIG. 2.
Figure 7:
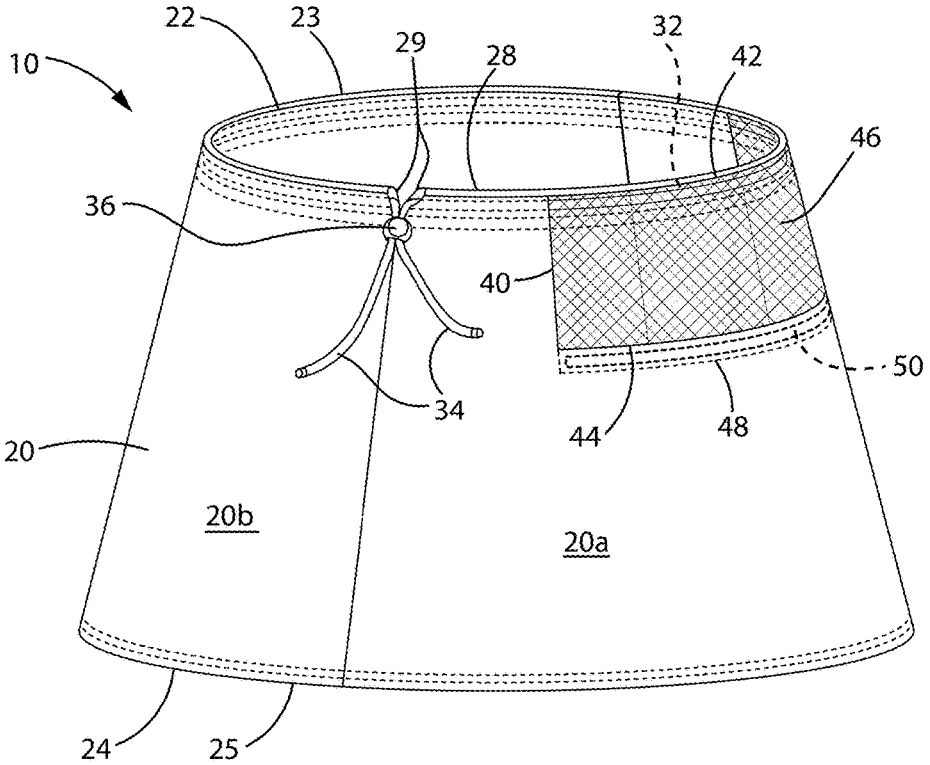
FIG. 7 is a perspective view of the nursing cover of FIG. 2.

Referring now specifically to FIGS. 6-9, in operation, when the two ends 34 of the drawcord 32 extending out of the drawcord channel 28 are short (e.g., as shown in FIG. 7), the top opening 23 of the main body 20 is in an open position and the top opening 23 is relatively large (e.g., as shown in FIG. 6). When the top opening 23 is in the open position, a mother is able to readily place the nursing cover 10 in a desired position on the mother's body.

Figure 8:
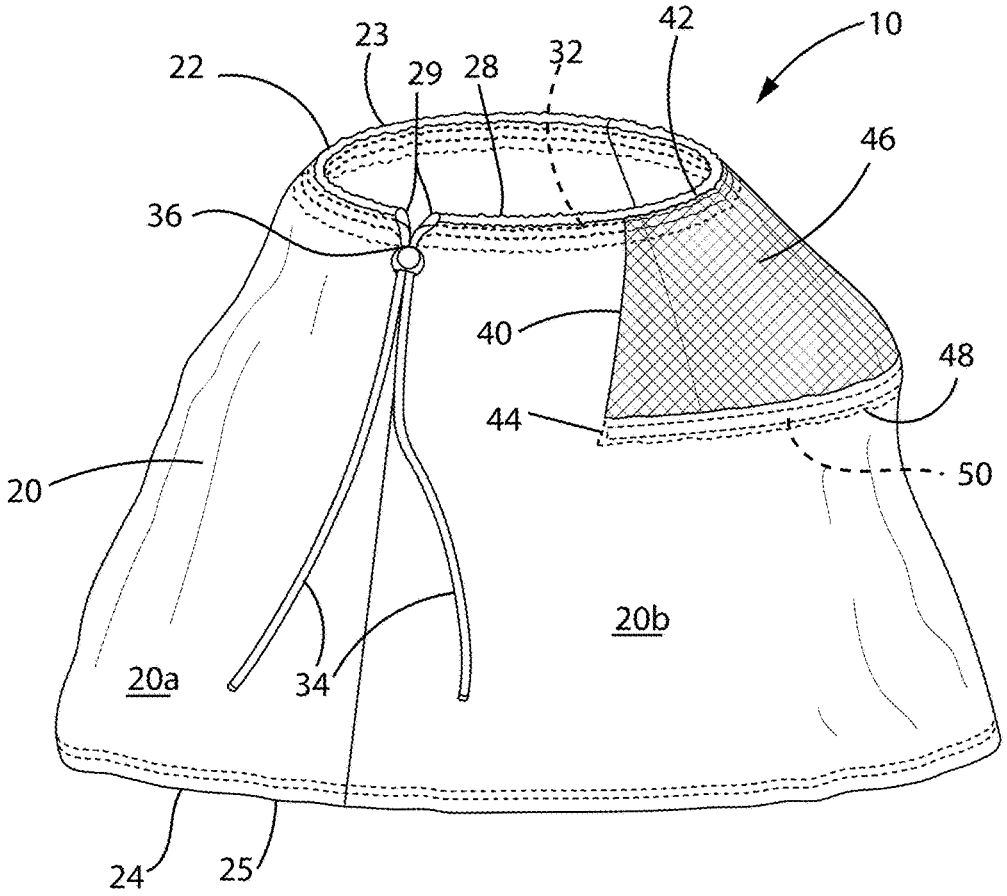
FIG. 8 is a perspective view of the nursing cover of FIG. 2 with the top opening in a closed position.
Figure 9:
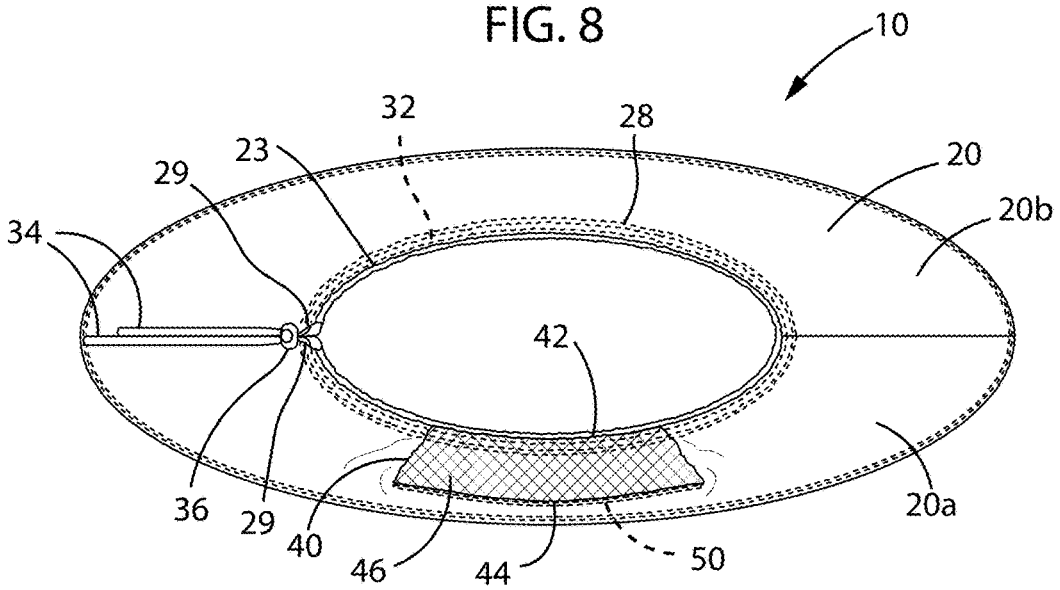
FIG. 9 is a top view of the nursing cover of FIG. 8 with the top opening in the closed position.

When the two ends 34 of the drawcord 32 extending out of the drawcord channel 28 are longer (e.g., as shown in FIG. 8), the top opening 23 of the main body 20 is in a closed position and the top opening 23 is relatively small (e.g., as shown in FIG. 9). When the top opening 23 is in the closed position, the top opening 23 is smaller than the mother's shoulders such that the nursing cover 10 rests securely on the mother's shoulders, for example as shown in FIG. 1. It is contemplated that a mother can readily adjust the draw string between the opened position shown in FIGS. 6 and 7 and the closed position shown in FIGS. 8 and 9 by reaching out through the bottom opening 25 of the nursing cover 10 and pulling the two ends 34 of the drawcord 32 outward to increase their length and thus decrease the size of the top opening 23. In this embodiment, the toggle 36 is then used to prevent the two ends 34 of the drawcord 32 from sliding back into the drawcord channel 28, but it contemplated that other means of securing the two ends 34 of the drawcord 32 can be used, including simply tying the two ends 34 into a bow knot or the like.

Referring still to FIGS. 6-9, but now with respect to the viewing window 40, in the exemplary nursing cover 10, the upper edge 42 of the viewing window 40 is coextensive with a portion of the drawcord channel 28. In this way, upon pulling the two ends 34 of the drawcord 32 outward and decreasing the size of the top opening 23, the length of the upper edge 42 of the viewing window 40 is also reduced. The boning 50 positioned adjacent to the lower edge 44 of the viewing window 40 prevents the lower edge 44 of the viewing window 40 from similarly shortening. Instead, as a result of the reduced length of the upper edge 42 of the viewing window 40, the boning 50 is bent further which pushes the lower edge 44 of the viewing window farther away from the mother's chest, advantageously improving the mother's view of the nursing infant.

Of course, the viewing window need not be positioned immediately adjacent to the top opening of the main body and the means for adjust the size of the top opening need not be a draw string, but in general it is contemplated that in embodiments of the nursing cover of the present invention where boning is present along the lower edge of the viewing window that adjusting the size of the top opening will reduce the length of the upper edge of the viewing window causing the boning to flex and push the lower edge of the viewing window farther away from the mother's chest. In embodiments where there is no boning, the natural lay of the nursing cover of the mother's shoulders will still allow the mother to see the nursing infant through the viewing window.

One of ordinary skill in the art will recognize that additional embodiments are also possible without departing from the teachings of the presently-disclosed subject matter. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and can be made without departing from the spirit and scope of the presently-disclosed subject matter.

What is claimed is:

1. A nursing cover for covering a mother's body and a nursing infant, the nursing cover comprising:

a substantially cylindrical main body having an upper edge defining a top opening and lower edge defining a bottom opening;

a means for adjusting the size of the top opening;

a viewing window defined by the main body, the viewing window having an upper edge positioned adjacent to the upper edge of the main body and a lower edge positioned along the main body towards the lower edge of the main body; and boning positioned adjacent to the lower edge of the viewing window, the boning configured to maintain the lower edge of the viewing window away from the mother's body such that the viewing window is disposed to cross a line of sight of the mother from her eyes to the nursing infant.

2. The nursing cover of claim 1, wherein the boning is a comprised of a flexible curved member.

3. The nursing cover of claim 2, further comprising a boning channel defined along the lower edge of the viewing window with the boning positioned within the boning channel.

4. The nursing cover of claim 3, wherein the boning is tacked to the main body preventing rotation of the boning within the boning channel.

5. The nursing cover of claim 1, further comprising a transparent panel extending across the viewing window.

6. The nursing cover of claim 5, wherein the transparent panel is comprised of a mesh fabric.

7. The nursing cover of claim 1, wherein the main body is comprised of a woven fabric.

8. The nursing cover of claim 1, wherein the means for adjusting the size of the top opening is a draw string comprising:

a drawcord channel defined around the upper edge of the main body;

a drawcord extending through the drawcord channel, the drawcord having, two ends extending out of the drawcord channel; and a toggle configured to selective hold the two ends of the drawcord extending out of the drawcord channel.

9. The nursing cover of claim 8, wherein the drawcord is tacked to the main body at at least one location.

10. The nursing cover of claim 8, wherein the upper edge of the viewing window is coextensive with a portion of the drawcord channel such that upon reducing the size of the top opening a length of the upper edge of the viewing window is shortened.

11. A nursing cover for covering a mother's body and a nursing infant, the nursing cover comprising:

a substantially cylindrical main body having an upper edge defining a top opening and lower edge defining a bottom opening;

a drawcord channel defined around the upper edge of the main body;

a drawcord extending through the drawcord channel, the drawcord having two ends extending out of the drawcord channel;

a viewing window defined by the main body, the viewing window having an upper edge positioned adjacent to a portion of the drawcord channel and a lower edge positioned along the main body towards the lower edge of the main body;

a mesh fabric extending across the viewing window;

a boning channel defined along the lower edge of the viewing window; and boning positioned within the boning channel, the boning configured to maintain the lower edge of the viewing window away from the mother's body such that the mesh fabric is disposed to cross a line of sight of the mother from her eyes to the nursing infant.

12. The nursing cover of claim 11, wherein the boning is a comprised of a flexible curved member.

13. The nursing cover of claim 11, wherein the boning is tacked to the main body preventing rotation of the boning within the boning channel.

14. The nursing cover of claim 11, further comprising a toggle configured to selective hold the two ends of the drawcord extending out of the drawcord channel.

15. The nursing cover of claim 11, wherein the drawcord is tacked to the main body at at least one location.

16. The nursing cover of claim 11, wherein upon reducing the size of the top opening of the main body a length of the upper edge of the viewing window is shortened.

17. A nursing cover for covering a mother's body and a nursing infant, the nursing cover comprising:

a substantially cylindrical main body having an upper edge defining a top opening and lower edge defining a bottom opening;

a drawcord channel defined around the upper edge of the main body;

a drawcord extending through the drawcord channel, the drawcord having two ends extending out of the drawcord channel;

a viewing window defined by the main body, the viewing window having an upper edge coextensive with a portion of the drawcord channel and a lower edge positioned along the main body towards the lower edge of the main body; and a mesh fabric extending across the viewing window;

wherein the mesh fabric is disposed to cross a line of sight of the mother from her eyes to the nursing infant.

* * * * *